US005975246A

United States Patent [19]

Toschi

[11] Patent Number: 5,975,246

[45] Date of Patent: Nov. 2, 1999

[54] HYDRAULICALLY BALANCED ELEVATOR

[75] Inventor: Renzo Toschi, Bologna, Italy

[73] Assignee: Otis Elevator Company, Farmington, Conn.

[21] Appl. No.: 08/864,419

[22] Filed: May 28, 1997

[51] Int. Cl.[6] ..... B66B 9/04

[52] U.S. Cl. ..... 187/275; 91/454

[58] Field of Search ..... 187/275, 272, 187/279, 253, 404, 414; 91/454, 449, 452

[56] References Cited

U.S. PATENT DOCUMENTS

| | | | |
|---|---|---|---|
| 5,014,823 | 5/1991 | Pelto-Haikko | 187/275 |
| 5,238,087 | 8/1993 | Garrido et al. | 187/253 |

FOREIGN PATENT DOCUMENTS

| | | |
|---|---|---|
| 2735310 | 2/1979 | Germany . |
| 3136739 | 3/1983 | Germany . |
| 9012693 | 2/1991 | Germany . |

*Primary Examiner*—Kenneth W. Noland

[57] ABSTRACT

A hydraulic elevator includes a car engaged with a first hydraulic ram, a counterweight engaged with a second hydraulic ram, and a pump to transfer hydraulic fluid between the hydraulic rams. The counterweight hydraulically balances the car without the requirement of a roped connection between the car and counterweight. A fluid flow system controls the transfer of hydraulic fluid between the hydraulic rams. As a result, there is no tank or reservoir for hydraulic fluid.

17 Claims, 2 Drawing Sheets

HYDRAULICALLY BALANCED ELEVATOR

TECHNICAL FIELD

The present invention relates to hydraulic elevator systems, and more particularly to such elevator systems that include counterweights.

BACKGROUND OF THE INVENTION

Conventional hydraulic elevators include a hydraulically driven ram to raise an elevator car. Lowering of the car is typically accomplished by permitting fluid to exit the cylinder of the hydraulic ram and using the weight of the car to force the fluid out of the cylinder. A piston of the hydraulic ram may be directly engaged with the car or may be engaged with the car via a rope fixed to the hoistway and engaged with a sheave on a yoke on the piston. The latter arrangement provides the benefit of not requiring space under the hoistway for the hydraulic cylinder, although at the price of requiring additional space adjacent to the travel path of the car.

One advantage of hydraulic elevators as compared to traction elevators is the lower cost of the installation. A disadvantage, however, is the higher power requirements for the hydraulic pump as compared to similar sized traction elevators. This is in part the result of the hydraulic ram having to carry the weight of the car and the passenger load.

One method to reduce the power requirements of hydraulic elevators is to use a counterweight, as is done with traction elevators. In U.S. Pat. No. 5,238,087, issued to Garrido et al and entitled "Advanced Energy Saving Hydraulic Elevator", a double-acting hydraulic cylinder is used with a counterweighted hydraulic elevator. The double-acting hydraulic cylinder permits the car to be driven in both the upward and downward direction, thus allowing the counterweight to be heavier than the empty car. The double-acting cylinder is more expensive than a single-acting hydraulic cylinder and requires more complex control of the hydraulic elevator.

In another example disclosed in U.S. Pat. No. 5,014,823, issued to Pelto-Huikko and entitled "Apparatus for Improving the Performance of a Motor-Controlled Hydraulic Elevator", a single-acting hydraulic cylinder is used with a counterweight directly engaged with the car via a roped arrangement. This proposed solution requires additional hoistway space to accommodate the counterweight and the roping arrangement, and requires additional installation expenses due to the need to install the additional roping and sheaves for the counterweight.

The above art notwithstanding, engineers under the direction of Applicant's Assignee are working to develop hydraulic elevators that minimize power requirements and installation costs.

DISCLOSURE OF THE INVENTION

According to the present invention, a hydraulic elevator includes a car engaged with a first hydraulic ram, a counterweight engaged with a second hydraulic ram, and a pump to transfer hydraulic fluid between the hydraulic rams.

The advantage of the invention is that the energy consumption during operation is minimized. The use of a counterweight with a hydraulic elevator reduces the load on the pump and pump motor. In addition, having the counterweight and the car with interconnected hydraulic rams is an effective means to take advantage of the energy sharing without the need for a roped connection between the car and counterweight and without the expense and complexity of using a double-acting hydraulic cylinder.

According further to the present invention, the elevator has a predetermined volume of hydraulic fluid defined by a first cylinder, a second cylinder and a conduit disposed between the pump and the cylinders.

The further advantage of this configuration is that it minimizes the installation cost and the installed power requirements of the elevator system. Utilizing the volumetric space of the cylinders and conduits eliminates the need for a tank to transfer hydraulic fluid into, and to remove hydraulic fluid from, as the car is moved through the hoistway. In addition, the counterbalancing minimizes the power output requirements of the motor as a result of the load on the pump being minimized.

In specific embodiments of the present invention, both the car and counterweight may be directly loaded onto their associated rams, or the car may be roped such that its speed and vertical travel distance is twice the speed and travel distance of the counterweight, or both the car and counterweight may be roped to avoid the need to excavate a cavity to install the cylinders.

The foregoing and other objects, features and advantages of the present invention become more apparent in light of the following detailed description of the exemplary embodiments thereof as illustrated in the accompanying drawings.

BEST MODE FOR CARRYING OUT THE INVENTION

Figure 1:
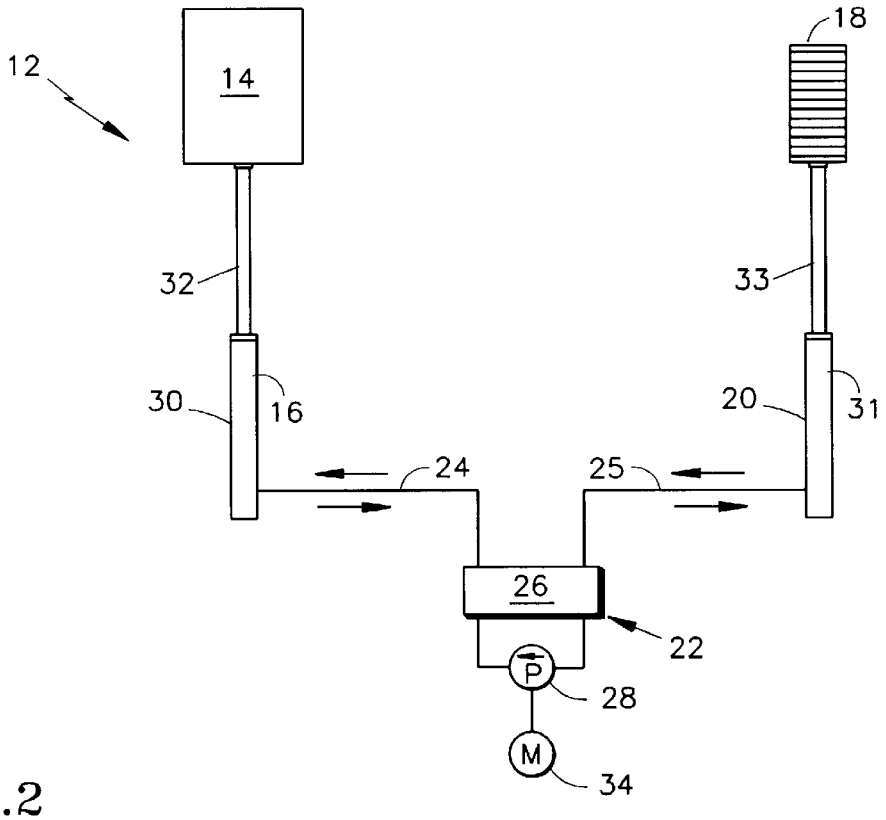
FIG. 1 is a schematic representation of a hydraulic elevator system according to the present invention.

Illustrated in FIG. 1 is a schematic representation of an elevator system 12. The elevator system 12 includes a car 14 mounted upon a hydraulic ram 16 and a counterweight 18 mounted upon a second hydraulic ram 20. The elevator system 12 further includes a fluid flow system 22 having a pair of conduits 24,25, a valve block 26 and a pump 28.

Each of the hydraulic rams 16,20 includes a cylinder 30,31 and a piston 32,33. The pistons 32,33 are engaged with the car 14 and counterweight 18, respectively. The cylinders 30,31 define pressure vessels such that flowing pressurized fluid into the cylinders 30,31 applies a force on the pistons 32,33 that urges the pistons 32,33 to move outward relative to the cylinders 30,31. As a result, the flow of fluid into and out of the cylinders 30,31 controls the position of the car 14 and counterweight 18.

The fluid flow system 22 defines means to transfer hydraulic fluid between the two hydraulic cylinders 30,31. The first conduit 24 connects the first cylinder 30 and the valve block 26, and the second conduit 25 connects the second cylinder 31 and the valve block 26. The valve block 26 defines means to control the transfer of fluid between the two cylinders 30,31. The valve block 26 includes means to meter the flow between the conduits 24,25 and means to check the flow to stop the transfer of fluid, and thereby movement of the pistons 32,33. The pump 28 includes a motor 34 to drive the pump 28 and is connected to the valve block 26 such that it receives fluid from the valve block 26 and, after increasing the pressure of the fluid, returns the fluid to the valve block 26.

During operation, the car 14 and counterweight 18 are moved in opposite vertical directions by transferring fluid between the two hydraulic rams 12,16. If it is desired to raise the car 14, the valve block 26 permits fluid to flow from the second cylinder 31 to the first cylinder 30. Fluid exiting the second cylinder 31 is flowed to the valve block 26, which directs this fluid to the pump 28. The pump 28 then engages this fluid to increase the pressure of the fluid and returns it to the valve block 26. The valve block 26 then directs this fluid to the first cylinder 30. The increase in flow and pressure to the first cylinder 30 causes the piston 32 to move outward and the car 14 to be raised. The exiting fluid from the second cylinder 31, and the corresponding decrease in fluid pressure, causes the piston 33 to move inward and the counterweight 18 to be lowered.

If it is desired to lower the car 14, the valve block 26 permits fluid to flow from the first cylinder 30 to the second cylinder 31. Fluid exiting the first cylinder 30 is flowed to the valve block 26, which directs this fluid to the pump 28. The pump 28 then engages this fluid to increase the pressure of the fluid and returns it to the valve block 26. The valve block 26 then directs this fluid to the second cylinder 31. The resulting flow and fluid pressures within the cylinders 30,31 cause the car 14 to lower and the counterweight 18 to rise.

Since the car 14 is hydraulically balanced by the counterweight 18, the output requirements of the motor 34 and pump 28 are minimized. For example, if the car 14 weight P is 1500 kg and the passenger load Q is 1500 kg, the load of the car 14 on the piston 32 is 3000 kg since it is equal to the car 14 weight P plus the passenger load Q, or (P+Q). For a fifty percent balancing of the passenger load, which is conventional, and using hydraulic rams 16,20 having the same cross-sectional area A1 and A2 for the pistons 32,33, respectively, the counterweight 18 would be 2250 kg, or (P+Q/2). In this example, the pump 28 would only have to produce enough pressure to lift 750 kg for a fully loaded or an empty car 14, rather than the entire weight of the car 14 and passenger load. The load of the counterweight 18 will assist the pump 28 to raise the car 14, and the load of the car 14 will assist the pump 28 to raise the counterweight 18.

In addition, there is no need for a fluid tank or reservoir in the configuration shown in FIG. 1. This advantage results because the cylinders 30,31, conduits 24,25, valve block 26 and pump 28 define the volume of the hydraulic fluid that is necessary. Fluid necessary to pump into the first cylinder 30 to raise the car 14 is drawn from the second cylinder 31, and fluid flowed out of the first cylinder 30 to lower the car 14 is flowed into the second cylinder 31. Elimination of the fluid tank or reservoir minimizes the installation costs for the elevator system 12 and, since the pump 28 does not have to be submerged in a tank of fluid, facilitates maintenance of the pump 28 and minimizes the costs associated with such maintenance.

Figure 2:
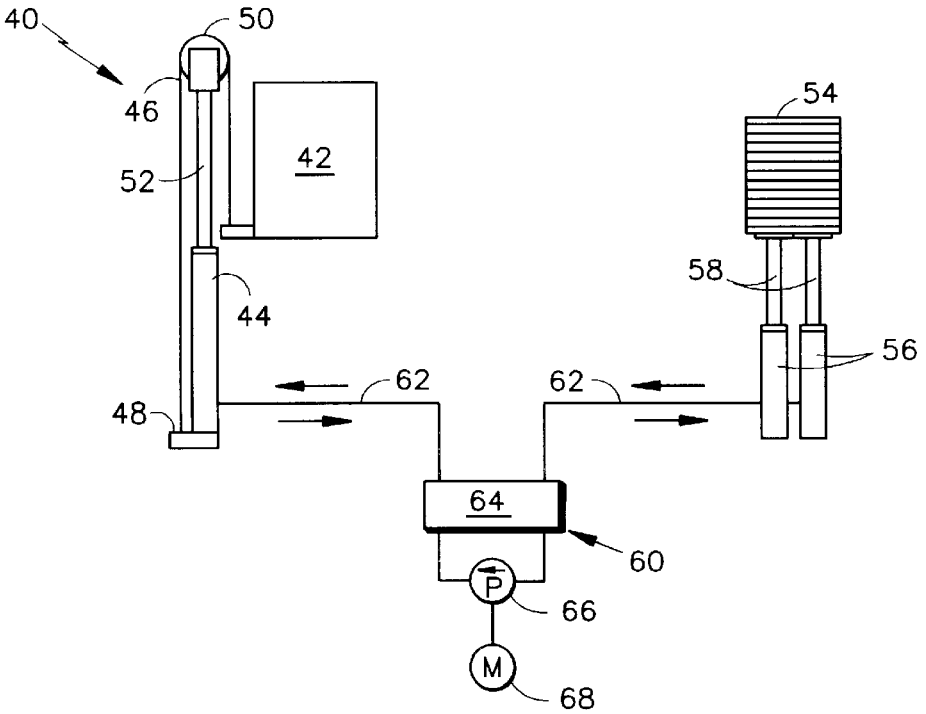
FIG. 2 is a schematic representation of an alternate embodiment of present invention.
Figure 3:
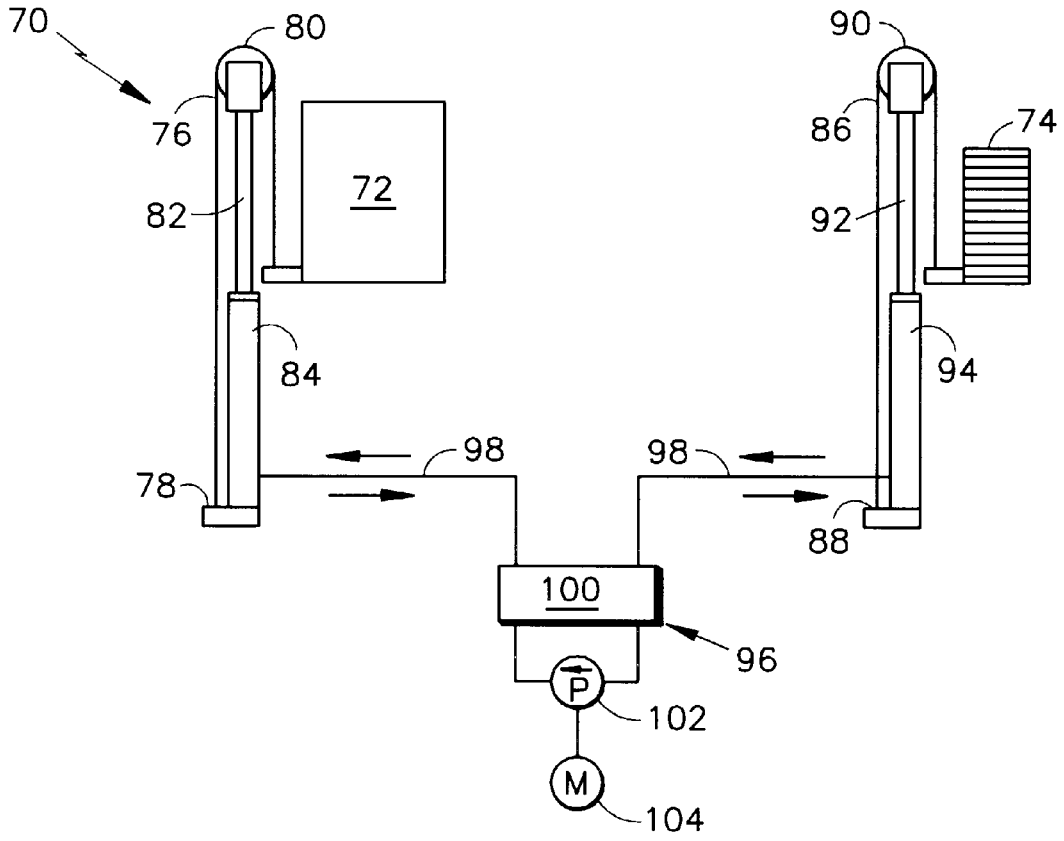
FIG. 3 is a schematic representation of another alternate embodiment of the present invention.

Illustrated in FIGS. 2 and 3 are alternate embodiments of the present invention. Shown schematically in FIG. 2 is an elevator system 40 having a car 42 engaged with a hydraulic ram 44 via a rope 46, rather than directly mounted on a piston as shown in FIG. 1. The rope 46 extends from a dead-end hitch 48 to the car 42 and extends over a sheave 50 mounted to the distal end of a piston 52. This roping configuration results in a 2:1 relationship between the car 42 and the piston 52. In effect, the car 42 moves at twice the speed and twice the distance relative to the piston 52 motion. This roping configuration also results in the car 42 applying twice the load on the piston 52, or (2×(P+Q)).

To balance the load of the car 42, the elevator system 40 includes a counterweight 54 having a pair of hydraulic rams 56. Each of the pair of rams 56 has a piston 58 having the same cross-sectional area A2 and A3 as the cross-sectional area A1 of the ram 44 associated with the car 42, although each ram 56 is only half the height of the car ram 44. Therefore, the rams 56 of the counterweight 54 have, in total, twice the cross-sectional area as the ram 44 of the car 42, i.e., (A2+A3)=2×A1. As a result, movement of the counterweight 54 causes twice as much fluid to flow into the car 42 ram 44 and causes the piston 52 to move twice the distance and twice the speed of the counterweight 54 pistons 58. It should be apparent to one skilled in the art, however, that the pair of counterweight rams 56 may be replaced by a single ram that has a piston with twice the cross-sectional area as the piston 52 of the car 42 ram 44.

The elevator system illustrated in FIG. 2 also includes a fluid flow system 60. The fluid flow system 60 includes a pair of conduits 62, a valve block 64, and a pump 66 having a motor 68, which function in a similar manner as described with respect to the fluid flow system shown in FIG. 1. One difference, however, is that the valve block 64 communicates with both of the hydraulic rams 56 and transfers fluid between both rams 56 and the car ram 44.

During operation, fluid is transferred between the car ram 44 and the counterweight rams 56. Movement of the counterweight 54 causes the piston 52 of the car 42 ram 44 to move at twice the speed and distance as the counterweight 54. Since the car 42 is roped as shown, movement of the piston 52 causes the car 42 to move twice the speed and distance as the piston 52. Therefore, the car 42 moves at four times the speed and distance as the counterweight 54. This permits the counterweight 54 rams 56 to be shorter and the counterweight 54 may be disposed within a more confined space.

The configuration of FIG. 2 may also require a counterweight 54 that is heavier than the car 42 load. For example, if the car 42 weight P is 570 kg and the passenger load Q is 630 kg, the car 42 load (P+Q) is 1200 kg. For a fifty percent balancing of the passenger load, the weight of the counterweight 54 would be equal to the car 42 weight plus half of the passenger load multiplied by two (to account for the doubling in cross-sectional areas of the counterweight 54 pistons 58) and multiplied again by two to account for the roping arrangement or (2*2*(P+Q/2)), or (4P+2Q). This results in a counterweight 54 weighing 3540 kg.

Another alternate embodiment is shown schematically in FIG. 3. This embodiment includes an elevator system 70 having a roped car 72 and a roped counterweight 74. The car rope 76 extends from a dead-end hitch 78 to the car 72 and is engaged with a sheave 80 mounted on a piston 82 extending out from a car 72 ram 84. The counterweight 74 rope 86 extends from a dead-end hitch 88 to the counterweight 74 and is engaged with a sheave 90 mounted on a piston 92 extending out from a counterweight ram 94. As with the other configurations, the elevator system 70 includes a fluid flow system 96 having a pair of conduits 98, a valve block 100 and a pump 102 having motor 104. The fluid flow system 96 operates in a similar manner as the fluid flow systems shown in FIGS. 1 and 2.

In this embodiment, both the car 72 and the counterweight 74 move at twice the speed and twice the distance of their respective pistons 82,92. This results in the car 72 and counterweight 74 moving at the same speed but in opposite directions. As opposed to the embodiment of FIG. 2, this elevator system 70 may use a lighter counterweight 74, although it will require more vertical travel distance for the counterweight 74 than the embodiment of FIG. 2. For example, if the car 72 weight P is 570 kg and the passenger load Q is 630 kg, the car 72 load is 1200 kg. For fifty percent balancing, the counterweight 74 would weigh (P+Q/2), or 885 kg. An advantage of this configuration is that there is no need to excavate a hole for the construction of either the car ram 84 or the counterweight ram 94.

Although the invention has been shown and described with respect to exemplary embodiments thereof, it should be understood by those skilled in the art that various changes, omissions, and additions may be made thereto, without departing from the spirit and scope of the invention.

What is claimed is:

1. A hydraulic elevator including:

a car engaged with a first hydraulic ram, the first hydraulic ram including a first cylinder;

a counterweight engaged with a second hydraulic ram, the second hydraulic ram including a second cylinder; and a fluid flow system that operates to transfer hydraulic fluid between the first hydraulic ram and the second hydraulic ram, the fluid flow system including a valve block, a pump and a fluid conduit connecting the valve block to the cylinders, wherein the valve block controls the transfer of fluid between cylinders, and wherein the cylinders, valve block, pump, and the fluid conduit define the volume of hydraulic fluid.

2. The hydraulic elevator according to claim 1, wherein at least one of the hydraulic rams includes a sheave engaged with a rope, the rope being engaged with either the car or the counterweight.

3. The hydraulic elevator according to claim 2, wherein each of the first and second hydraulic rams includes a sheave engaged with a rope, wherein the rope engaged with the first hydraulic ram is engaged with the car, and wherein the rope engaged with the second hydraulic ram is engage with counterweight.

4. The hydraulic elevator according to claim 2, further including a first rope engaged with the sheave of the first hydraulic ram and a second rope engaged with the sheave of the second hydraulic ram.

5. The hydraulic elevator according to claim 1, further including a third hydraulic ram engaged with the counterweight, and wherein the fluid flow system operates to transfer hydraulic fluid between the first hydraulic ram and the second and third hydraulic rams.

6. The hydraulic elevator according to claim 5, further including a rope engaged with the car, and wherein the first hydraulic ram includes a sheave engaged with the rope.

7. The hydraulic elevator according to claim 1, wherein the first hydraulic ram has a functional surface area A1, wherein the second hydraulic ram has a functional surface area A2, and wherein A2>A1.

8. The hydraulic elevator according to claim 7, wherein A2=(2×A1).

9. The hydraulic elevator according to claim 7, further including a rope engaged with the car, and wherein the first hydraulic ram includes a sheave engaged with the rope.

10. A hydraulic elevator including:

a car engaged with a first hydraulic ram;

a counterweight engaged with a second hydraulic ram; and a fluid flow system that operates to transfer hydraulic fluid between the first hydraulic ram and the second hydraulic ram; and wherein at least one of the hydraulic rams includes a sheave engaged with a rope, the rope being engaged with either the car or the counterweight.

11. The hydraulic elevator according to claim 10, wherein each of the first and second hydraulic rams includes a sheave engaged with a rope, wherein the rope engaged with the first hydraulic ram is engaged with the car, and wherein the rope engaged with the second hydraulic ram is engage with the counterweight.

12. The hydraulic elevator according to claim 10, further including a first rope engaged with the sheave of the first hydraulic ram and a second rope engaged with the sheave of the second hydraulic ram.

13. A hydraulic elevator including:

a car engaged with a first hydraulic ram;

a counterweight engaged with a second hydraulic ram and a third hydraulic ram; and a fluid flow system that operates to transfer hydraulic fluid between the first hydraulic ram and the second and third hydraulic rams.

14. The hydraulic elevator according to claim 13, further including a rope engaged with the car, and wherein the first hydraulic ram includes a sheave engaged with the rope.

15. A hydraulic elevator including:

a car engaged with a first hydraulic ram, the first hydraulic ram having a functional surface area A1;

a counterweight engaged with a second hydraulic ram, the second hydraulic ram having a functional surface area A2, wherein A2>A1; and a fluid flow system that operates to transfer hydraulic fluid between the first hydraulic ram and the second hydraulic ram.

16. The hydraulic elevator according to claim 15, wherein A2=(2×A1).

17. The hydraulic elevator according to claim 15, further including a rope engaged with the car, and wherein the first hydraulic ram includes a sheave engaged with the rope.

* * * * *